United States Patent [19]

Steinhilber

[11] Patent Number: 4,635,923

[45] Date of Patent: Jan. 13, 1987

[54] DEVICE FOR THE FEEDING OF INDIVIDUAL SHEETS TO THE PLATEN OF AN OFFICE MACHINE

[76] Inventor: Friedhelm Steinhilber, Saline 29, 7210 Rottweil, Fed. Rep. of Germany

[21] Appl. No.: 727,923

[22] Filed: Apr. 29, 1985

[30] Foreign Application Priority Data

May 4, 1984 [DE] Fed. Rep. of Germany ..... 3416509

[51] Int. Cl.[4] ..... B65H 1/00

[52] U.S. Cl. ..... 271/162; 271/273

[58] Field of Search ..... 271/273, 274, 162, 163, 271/164, 8.1, 264

[56] References Cited

U.S. PATENT DOCUMENTS 3,661,383 5/1972 Morrison ..... 271/273

4,540,169 9/1985 Levinson ..... 271/164

FOREIGN PATENT DOCUMENTS 1966526 1/1973 Fed. Rep. of Germany ..... 271/162

*Primary Examiner*—Richard A. Schacher

*Attorney, Agent, or Firm*—Thomas P. Mahoney

[57] ABSTRACT

A sheet-feeding device for feeding individual sheets to the platen of an office machine is supported on top of the office machine by means of a contact section or sections engaging the shaft of the platen. The lower extremity of the contact section is laterally displaced from the plane of the sidewall of the sheet-feeding device to facilitate the adaptation of the sheet-feeding device to different widths of office machines.

5 Claims, 3 Drawing Figures

DEVICE FOR THE FEEDING OF INDIVIDUAL SHEETS TO THE PLATEN OF AN OFFICE MACHINE

BACKGROUND OF THE INVENTION

This invention relates to a device for feeding individual sheets to the platen of an office machine.

Various devices of this type are known to those skilled in the art and are customarily mounted on the top of the office machine engaging the latter by means of contact sections of its sidewalls and being positioned on the shaft of the platen of the office machine. The transport mechanism for the individual sheets, which are stacked in the sheet-feeding device, is driven by the platen of the office machine.

In order to transmit the rotary driving force of the platen, a gear, which is mounted on the contact section of the sidewall of the sheet-feeding device, engages a gear on the shaft of the platen. A drive train, incorporating gears mounted on the side sections, transfers the driving force to the transport mechanism of the sheet-feeding device.

In conventional sheet-feeding devices, the housing incorporating the right and left-hand sidewalls, which engage the shaft of the platen, is made of sheet metal. Since the platens of different office machines frequently differ in respect to their width from one another, it is customarily necessary that a sheet-feeding device be provided whose housing corresponds in width to the width of the platen of the office machine. In other words, a sheet-feeding device must be provided having a housing whose width between the sidewalls is the same as the width of the platen of the office machine with which it is to be utilized. This entails the manufacture and storage of numerous housings for sheet-feeding devices to accommodate the differences in width of various office machines.

OBJECTS AND ADVANTAGES OF THE INVENTION

In a sheet-feeding device constructed in accordance with the teachings of my invention, the contact section is displaced in a stepwise manner with respect to the plane of the respective sidewall of the housing of the sheet-feeding device, with this applying at least to one sidewall of said housing. This stepwise displacement of the contact section makes it possible to adapt the distance of the contact sections of the two sidewalls of the housing of the sheet-feeding device to the width of the platen of a specific office machine without any change in the housing of the sheet-feeding device itself.

Consequently, the basic sheet-feeding device including the housing, the holder for the storage unit for the individual sheets and the transport mechanism can be manufactured of strong metallic components and can be used for all platen widths because of the accommodation in width made possible by the utilization of the contact section or sections of my invention.

Therefore, the utilization of one or more contact sections selected in accordance with the type of office machine to be used at the present time permits a single sheet-feeding device to be manufactured and stored with corresponding reductions in manufacturing costs and inventory maintenance.

In addition, considerable economies are derived from the injection molding of the contact sections from synthetic plastic materials which enables a large number of different sizes of contact sections to be kept in readiness for the different types of office machines. Furthermore, manufacture of the contact sections by the use of the injection molding process permits the sections to be produced in a simple manner with a high degree of precision, which results in an accurate adaptation of the contact sections of a particular sheet-feeding device to the width of the platen of the respective office machine.

It is, therefore, a primary object of my invention to provide a sheet-feeding device for utilization in conjunction with the platen of an office machine wherein said office machine incorporates a contact section or sections juxtaposed to a sidewall of the housing of the sheet-feeding device to permit said sheet-feeding device to be accommodated to the width of the platen of the office machine with which it is utilized.

Another object of my invention is the provision of a contact section or sections of the aforementioned character incorporating a concealment flange on the edge of contact section or sections facing the user, which flange projects on both sides and conceals the displacement caused by the stepwise configuration of the concept of the contact section.

Another object of my invention is the provision of a device of the aforementioned character wherein the concealment flange also conceals the gear unit installed in said contact section.

Therefore, the spaces caused by the stepwise configuration of the contact section and the gear unit mounted in one of the contact sections are concealed from view and the gear unit is protected from unauthorized tampering.

An additional object of my invention is the provision of a shroud-like collar which covers the access opening through which the contact sections are inserted in the top of the office machine during the process of placing the sheet-feeding device in operative relationship with the shaft of the platen of said office machine. Consequently, when the sheet-feeding device is installed a completely closed housing for the office machine results therefrom, preventing unauthorized tampering with the interior of the office machine.

Another object of my invention is the provision of a contact section in which the gear train is displaced in accordance with the displacement of the contact section necessitated by accommodation of the width of the platen of the office machine, the gears in the gear train being correspondingly displaced. In order to accommodate this displacement, the gear which is driven by the platen driven gear is of substantially greater width than the other gears of the gear train so that it extends beyond the plane of the contact section. Therefore, the lateral displacement of the gear train occasioned by the lateral displacement of the contact section is accommodated by substantially extending the width of the next-to-lowermost gear of the gear train.

An additional object of my invention is the provision of a contact section for a sheet-feeding device wherein the gears of the gear train can be arranged on opposite sides of the contact section.

Another object of my invention is the provision, in the lower extremity of the contact section, of a recess which engages the shaft of the platen, said recess being so dimensioned that it can be flexibly snapped onto the shaft to insure stable affixation of the sheet-feeding device to the office machine and to also insure accurate engagement between the driving gear of the platen and the driven gear of the contact section.

BRIEF DESCRIPTION OF THE DRAWING

Other objects and advantages of the invention will be apparent from the following specification and the accompanying drawings in which.

DESCRIPTION OF PREFERRED EMBODIMENTS OF THE INVENTION

Figure 1:
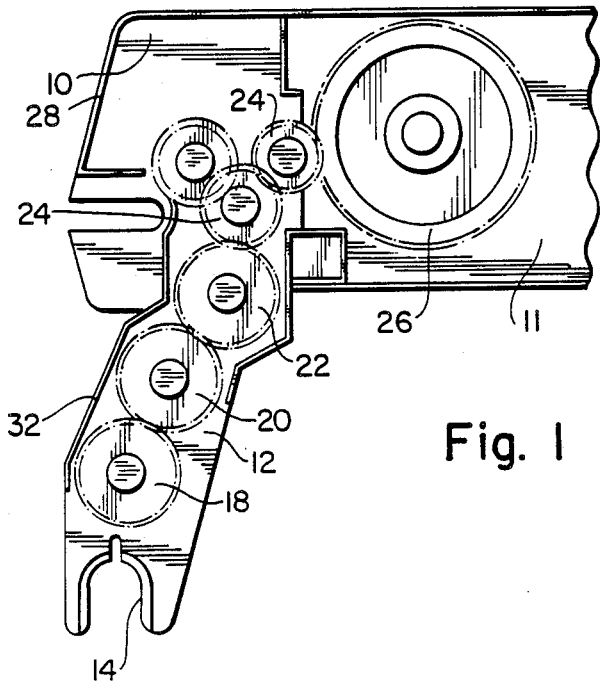
FIG. 1 is a side view of the sheet-feeding device.
Figure 2:
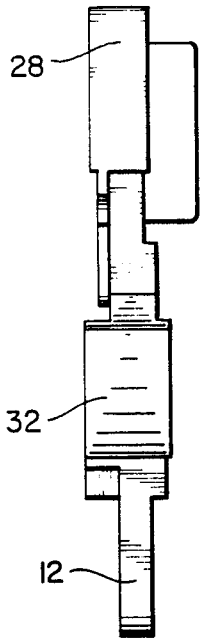
FIG. 2 is a front elevational view of the sidewall of the sheet-feeding device incorporating the associated contact section.
Figure 3:
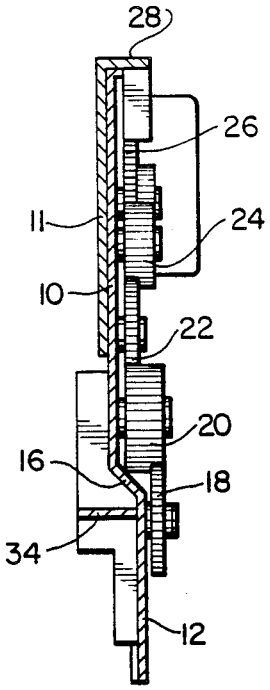
FIG. 3 is a vertical sectional view.

Referring to the drawing, and particularly to FIGS. 1–3 thereof, I show only the right-hand sidewall of the sheet-feeding device. Apart from the fact that the gear train is provided on only one sidewall, the left-hand sidewall is a reverse construction of the right-hand sidewall. As mentioned previously, it is not always necessary to incorporate two contact sections on the sidewalls of the sheet-feeding device, but should this become necessary to adapt the sheet-feeding device to the width of the platen of the respective business machine, the contact sections can be displaced to a greater or lesser degree in the case of the other sidewall.

In other words, the amount of stepwise lateral displacement provided by the other sidewall can be less or greater than that achieved by the first sidewall.

Since the remaining components of the sheet-feeding device, including the housing parts connecting the sidewalls, the storage unit for the individual sheets which is incorporated in the housing, the separating devices and the transport mechanism are designed in the usual manner, they are, therefore, not illustrated in the drawing and not described in the ensuing textual material.

The right-hand sidewall 11 of the housing of the sheet-feeding device incorporates a contact section 12 which is, as previously mentioned, fabricated by the injection molding process through the use of synthetic plastic materials.

The contact section 12 projects downwardly from the sidewall 11 in a slanted direction toward the user.

When the sheet-feeding device is installed on the top of an associated office machine, the contact section 12 is inserted through an insertion opening, not shown, in the top of the machine and an engagement recess or opening 14 on the lower extremity of the control section 12 is pressed onto the shaft of the platen.

The dimension of the engagement opening or recess 14 is such that it is slightly less in width than the diameter of the shaft so that displacement of the material defining the opening 14 occurs when the opening 14 is pressed upon the relevant portion of the shaft of the platen. Therefore, a snap-action occurs between the engagement opening or recess 14 and the perimeter of the shaft, which results in the stable affixation of the housing of the sheet-feeding device in operative relationship with the respective office machine.

The contact section 12 incorporates a flat plate wall section 10 which is coplanar with the sidewall 11 of the housing and is screwed to said sidewall or otherwise affixed to the same. As previously mentioned, while the contact section 12 is fabricated by the injection molding process from synthetic plastic, the housing of the sheet-feeding device including the sidewalls 11 thereof is fabricated from sheet metal or other substantial material.

At the lower extremity of the wall 10 of the contact section 12 an integral step-like shoulder or joggle 16 is provided which laterally displaces the lower extremity of the contact section into a position in which the engagement opening or recess 14 can be readily engaged upon the corresponding perimeter of the shaft of the platen of the respective office machine. Obviously, the length of the step-like shoulder or joggle 16 determines the magnitude of the displacement of the lower extremity on the contact section 12 and is determined, in differently configured contact sections 12, by the width of the platen of the respective office machines.

Mounted below the shoulder 16 in the upper portion of the lower extremity of the contact section 12 is a gear 18 which engages with a gear, not shown, on the shaft of the platen driven by the rotary movement of said shaft. The driving power of the platen gear is transmitted through the gear 18 and a gear train 20, 22 and 24 to a gear 26 which drives the components of the sheet-feeding device.

Because the gear 18 is mounted in the plane of the lower extremity of the contact section 12 below the step-like shoulder or joggle 16, and the gears 22, 24 and 26 are mounted in the plane of the wall section 10, the gear 20 is provided with a width of such dimension so that it extends beyond the plane of the lower extremity of the contact section 12 and is readily engaged with the gear 18, as best shown in FIG. 3 of the drawing.

While I have shown and described a particular arrangement of gears in the gear train, the gear train can be designed differently in regard to the number, size and arrangement of the gears. The gears can be eliminated and gear belts or similar transmission devices utilized in substitution therefor.

The sidewall 11 of the housing of the sheet-feeding device incorporates an outwardly projecting border or rim 28 to which a cover is secured in order to cover the gear train in the area of the sidewall 11 and the wall section 10.

Provided on the edge of the contact section 12 is a flange or shroud 32 which projects from both sides of the contact section 12 and essentially is juxtaposed to the border or rim 28 of the sidewall 11 and, on the other side, extends sufficiently so that, when the sheet-feeding device is installed on the office machine, it extends upwardly to the housing of the office machine. The width of the flange or shroud 32 is uniform and covers the relevant portion of the wall section 10, the step-like shoulder or joggle 16 and the lower extremity of the contact section 12. It also conceals and prevents access to the gear train, consisting of the gears 18 through 24.

Provided upon the lower extremity of the flange 32 is a concealment collar 34 which closes off the insertion opening between the housing of the office machine and the relevant portion of the sidewall 11 and contact section 12.

Therefore, by my invention it is possible to utilize a sheet-feeding device installed in a housing of a predetermined width, while achieving the modification of the housing by the utilization of contact sections of different offset dimensions to permit the utilization of the sheet-feeding device with platens of different widths. In addition, the contact sections also incorporate various shrouding means to prevent the user of the office machine from being injured thereby or from unauthorized access thereto.

I claim:

1. A contact section for utilization in conjunction with the sidewall of a sheet-feeding device to facilitate the accommodation of said sheet-feeding device to office machines having platens of different width, including, an attachment portion for permitting securement of said contact section to said sidewall of said sheet-feeding device, a stepwise joggle located intermediate the extremities of said contact section and a lower extremity displaced laterally by said stepwise joggle and disposed parallel to the plane of the sidewall of said sheet-feeding device.

2. The section of claim 1 which incorporates an elongated flange for concealing portions of the contact section and sheet-feeding device.

3. The section of claim 2 which incorporates a concealment collar for sealing the insertion opening of the sheet-feeding device when the sheet-feeding device is installed upon said office machine.

4. The section of claim 1 incorporating a gear train which includes a gear having a width projecting axially beyond the plane of the lower extremity of the contact section.

5. The contact section of claim 1 having an engagement opening at the lower extremity thereof, said engagement opening being of a width less than the diameter of the platen shaft of said office machine so that said engagement opening snaps onto said shaft.

* * * * *